United States Patent [19]

Dimier et al.

[11] Patent Number: 4,589,673

[45] Date of Patent: May 20, 1986

[54] RELEASE MECHANISM FOR A SKI BINDING

[75] Inventors: Jean-Pierre Dimier, Rumilly; Roger Pascal, Annecy-le-Vieux, both of France

[73] Assignee: Salomon S.A., Annecy, France

[21] Appl. No.: 471,168

[22] Filed: Mar. 1, 1983

[30] Foreign Application Priority Data

Feb. 3, 1982 [FR] France ..... 82 03973

[51] Int. Cl.[4] ..... A63C 9/08

[52] U.S. Cl. ..... 280/630; 280/612

[58] Field of Search ..... 280/612, 613, 630

[56] References Cited

U.S. PATENT DOCUMENTS

| | | | |
|---|---|---|---|
| 3,794,339 | 2/1974 | Smolka | 280/612 |
| 3,826,509 | 7/1974 | Smolka | 280/612 |
| 3,947,051 | 3/1976 | Sittmann | 280/612 |
| 4,398,747 | 8/1983 | Bernard | 280/630 |

FOREIGN PATENT DOCUMENTS

| | | | |
|---|---|---|---|
| 3017841 | 11/1981 | Fed. Rep. of Germany . | |
| 2375880 | 7/1978 | France . | |
| 2395046 | 2/1979 | France | 280/630 |
| 2418657 | 9/1979 | France . | |
| 2481938 | 11/1981 | France . | |

*Primary Examiner*—John J. Love
*Assistant Examiner*—Joseph G. McCarthy
*Attorney, Agent, or Firm*—Sandler & Greenblum

[57] ABSTRACT

A release mechanism for assisting a binding to resist pivoting about an element fixed to the ski. The mechanism includes an adjustable mechanical release mechanism for producing an initial release retention force, and a hydraulic pneumatic or mechanical assistance mechanism controlled by an electronic control, for increasing the initial release retention force. The initial release retention force is produced by a spring biasing a piston against the element fixed to the ski. The assistance mechanism increases the initial release retention force in response to a signal received by sensors on the binding indicating that the boot is attached to the binding. When shocks are sensed by the sensors, a signal is produced reducing the release retention force added by the assistance system. In the event that the electronic control fails, the binding still experiences the initial release retention force produced by the mechanical release mechanism.

60 Claims, 15 Drawing Figures

RELEASE MECHANISM FOR A SKI BINDING

FIELD OF THE INVENTION

This invention generally relates to a release mechanism for a ski binding, and more specifically to a combination mechanical and electrical release mechanism.

BACKGROUND OF THE INVENTION

Electronic release mechanisms for safety bindings have been developed as an alternative to traditional mechanical bindings. Although they offer advantages over traditional, mechanical safety bindings, electronic releases also suffer certain disadvantages. For example, they must be powered by a portable power source, such as a battery, which may fail and incapacitate the release mechanism.

In response to this problem, safety bindings that contain electronic release mechanisms have been combined with mechanical release mechanisms which are activated when the electronic release mechanism falls. One such binding is German Patent DE 3017841, which acts as a purely mechanical, hydraulic, or pneumatic emergency release mechanism when the electronic release does not function. When the electronic release mechanism does function, the mechanical, hydraulic, or pneumatic release is inoperative.

This release, however, still suffers important shortcomings. First, the acceptability of this binding to skiers is limited because, like bindings whose releases are totally electronic, the shocks received by the ski are directly transmitted to the skier's leg. Thus, the electronic release is constantly being exposed to shocks and is likely to fail. Second, when pressure on the system occurs due to relatively weak forces of low value over a long period of time (for example, the forces which occur as a result of changing weight of the skis by 180° direction changing of the skis) the risk of undesired releases increase. Third, in the event that the electronic release mechanism fails, the mechanical, hydraulic, or pneumatic release system which becomes operative may be adjusted differently from the electronic release, thereby causing the skier great difficulty. This occurs because the mechanical, hydraulic, or pneumatic release is adjusted independently from the electronic release system. Thus, when the electronic release system fails, the skier may suddenly find his boot held to the ski by a binding that has a release threshold and characteristics considerably different from the characteristics and threshold which were in operation before the failure of the electronic system. This situation is extremely detrimental to the safety of the skier, who suddenly finds himself in ski conditions which do not correspond to his level of expertise.

Thus, there is a need for a safety binding having an electronic release which coacts with a mechanical, hydraulic, or pneumatic release mechanism to ensure optimal retention even in the event that the electronic release fails.

SUMMARY OF THE INVENTION

It is an object of the present invention to provide a safety binding having an electronic release which coacts with a mechanical, hydraulic, or pneumatic release mechanism to ensure optimal retention until release of the boot, even in the event that the electronic release fails.

This and other objects of the present invention are attained by a novel release mechanism for a binding that is pivotable about a fixed axis. The release mechanism comprises a first release means and a second release means. The first release means produces an initial release retention force on the binding to cause the binding to resist pivoting about the fixed axis. The second release means increases the initial release retention force. The first release means includes a piston and a spring in the binding. The spring urges the piston against a fixed element attached to the ski to produce the initial release retention force. The second release means includes an electronic control mechanism for controlling the amount of increase in the initial release retention force. When the electronic control mechanism fails, the first release means continues to produce the initial release retention force.

The second release means may further include a force increasing means for increasing the initial release retention force and an electronic control mechanism. The electronic control mechanism further includes a current supply for supplying current to the force increasing means, and at least one sensor for sensing pressure on the binding, and sending a signal representing the pressure to the current supply. The amount of force added by the force increasing means is determined by the pressure sensed by the sensor. The mechanism may include two sensors, one of which is disposed on a sole gripping element and the other of which is disposed on a foot rest plate of the binding. When the boot is attached to the binding, the sensors are placed under pressure, and the force increasing means increases the initial release retention force. The first release means may be incorporated into a binding in combination with the release mechanism.

In another embodiment, the release mechanism comprises a mechanical release means and an electronic release assistance system. The mechanical release means produces the initial release retention force on the binding to cause the binding to resist pivoting about an element fixed to the ski. The electronic release assistance system increases the initial release retention force. It comprises a hydraulic circuit adapted to exert a force on the mechanical release means to increase the initial release retention force, and an electronic control means for controlling the amount of force exerted by the hydraulic circuit on the mechanical release means.

The mechanical release means includes a primary piston having a first end in contact with the element attached to the ski and a second end in contact with the hydraulic circuit. A spring is provided for biasing the first end of the piston against the fixed element of the ski to produce an initial release retention force. An adjustment element may be included for adjusting the bias on the spring.

The hydraulic circuit comprises a primary chamber, a secondary chamber, and a secondary piston adapted to reciprocate in the secondary chamber. The second end of the primary piston is in contact with the primary chamber so that the primary chamber may exert a force on the second end of the piston. The secondary chamber is of smaller cross-sectional area than the primary chamber and is in communication therewith. The reciprocating movement of the secondary piston in the secondary chamber is controlled by the electronic control means.

The secondary chamber may further include a cavity adapted to receive the secondary piston. When the secondry piston moves out of the cavity, the piston reduces the area through which the fluid flows in the secondary chamber, thereby increasing the initial release retention force.

The electronic control means comprises at least one sensor for sensing pressure on the binding and producing a signal, and a solenoid coil, disposed around the secondary piston and which is responsive to a signal from the sensor. An adjustable current supply may be provided, wherein the sensor and the solenoid coil are electrically connected to the current supply so that the current sent to the solenoid coil for a given pressure sensed by the sensor is adjustable. Two sensors may be provided, which are disposed respectively on the foot rest plate and the sole gripping element of the binding. When the electronic control means fails, the mechanical release system continues to produce an initial release retention force on the binding. In addition, the release mechanism may be incorporated into a binding.

In another embodiment, the release mechanism comprises a mechanical release means for producing an initial release retention force on the binding, to cause the binding to resist pivoting about an element fixed to the ski, and a release assistance system for increasing the initial release retention force. This system comprises a hydraulic circuit adapted to exert a force on the mechanical release means to increase the initial release retention force, and a control means for controlling the amount of force exerted by the hydraulic circuit on the mechanical release means.

The mechanical release means includes a primary piston and a primary spring, one end of which biases the piston against the element attached to the ski, to produce the initial release retention force. A support may be provided which contacts the other end of the primary spring. The support is adapted to be movable along the longitudinal axis of the binding, thereby controlling the force that the spring exerts against the piston. The support may have at least one opening therein for a purpose that shall be described hereinbelow.

The hydraulic circuit comprises a diaphragm, adapted to contain a fluid inside thereof and the primary spring. The diaphragm comprises a primary bellows disposed on one side of the support and a secondary bellows disposed on the other side of the support and in fluid communication through the opening in the support. Also provided is a closing ring disposed between the secondary bellows and the support and having at least one opening therein and which is also adapted to rotate. The openings on the supprt and the closing ring are located such that they completely overlap each other when the closing ring is rotated to a first position, and they partially overlap one another when the closing ring is rotated to a second position.

The closing ring includes a recess on the edge thereof, and the control means may include a finger which is adapted to move in the recess for controlling the rotation of the ring. A secondary spring biases the closing ring to continuously contact the finger. The shape of the recess is such that when the finger is disposed at a first position, a predetermined distance into the recess, the closing ring is in its first position and is stationary. When the finger is retracted to a second position the closing ring to its second position so that the opening in the closing ring partially overlaps the opening in the support.

The control means comprises an electronic control means having a current supply and a solenoid coil for receiving current therefrom and for controlling movement of the finger. At least one sensor may be provided for sensing pressure on the binding and sending a signal to the current supply, wherein, in response to the signal from the sensor, the current supply sends a current to the solenoid coil to move the finger. In addition, the release mechanism may be incorporated into the binding.

In another embodiment, the release mechanism comprises a first mechanical release means for producing an initial release retention force on the binding to cause the binding to resist pivoting about an element on the ski, and an electro-mechanical assistance system for selectively increasing the initial release retention force. The assistance system comprises an electronic control means and a second mechanical release means comprising an elastic means. The elastic means is responsive to the electronic control means, for increasing the initial release retention force. The electronic control means controls the amount of increase in the initial release retention force.

The first mechanical release means comprises a primary piston in contact with the element on the ski and a primary spring biasing the piston against the element. It further includes a sleeve, attached to the binding, so that one end of the primary spring contacts the sleeve, and the other end of the primary spring contacts the piston. The sleeve is movable along the longitudinal axis of the binding for controlling the bias of the spring. An adjustment element may also be included for controlling the position of the sleeve at locations along the longitudinal axis of the binding.

The sleeve has an opening therein for receiving a secondary piston adapted to reciprocate in the sleeve. The elastic means of the second mechanical release means is a secondary spring which contacts the primary and secondary pistons. A toggle joint may be provided for controlling the reciprocation of the secondary piston, and an electromagnet may also be provided, which is responsive to the electronic control means for controlling the movement of the toggle joint. At least one sensor may be provided on the binding for sensing pressure thereon and producing a signal. Also included may be a current supply, wherein the electromagnet is responsive to current from the current supply, and the current supply is responsive to the signal from the sensor. In addition, two sensors may be provided which are respectively located on the foot rest plate and the sole gripping element of the binding, and the release mechanism may be incorporated into the binding.

A further embodiment of the present invention includes a first mechanical release means in the binding and an assistance system. The first mechanical release means produces an initial release retention force on the binding, to cause the binding to resist pivoting about an element fixed to the ski. The first mechanical release system includes a piston in contact with the element, and a spring biasing the piston against the element to produce the initial release retention force.

The assistance system selectively increases the initial release retention force. It comprises an electronic control means and an element adapted to increase the initial release retention force. This element is attached to the boot and is responsive to the electronic control means. The electronic control means controls the amount of increase in the initial release retention force. When the assistance system fails, the first mechanical release means continues to provide an initial release retention force.

The element may be a finger which is disposed along the same longitudinal axis as the piston and which is adapted to reciprocate with respect to a cavity in the binding. The electronic control means controls the position of the finger with respect to the cavity. This is accomplished via a toggle joint. The movement of the finger is controlled by the toggle joint, and the toggle joint in turn is controlled by the electronic control means via at least one electromagnet. The electromagnet controls the movement of the toggle joint and is in turn controlled by the electronic control means.

The electronic control means further includes a current supply and at least one sensor for sensing pressure on the boot and sending a signal to the current supply. Current from the current supply powers the electromagnet, in response to a signal from the sensor. Two sensors may be provided, which may be located respectively on the foot rest plate and the sole gripping element of the binding. In addition, the first mechanical release means may be incorporated into the binding.

BRIEF DESCRIPTION OF THE DRAWINGS

The aforegoing and other objects, features, and advantages of the present invention will become more apparent to those of ordinary skill in the art to which the invention pertains in light of the following detailed descriptions of the preferred embodiments, as discussed and illustrated in the accompanying drawings, in which like reference characters designate like or corresponding parts throughout the several embodiments, and wherein.

DETAILED DESCRIPTION OF THE PREFERRED EMBODIMENT

Figure 1:
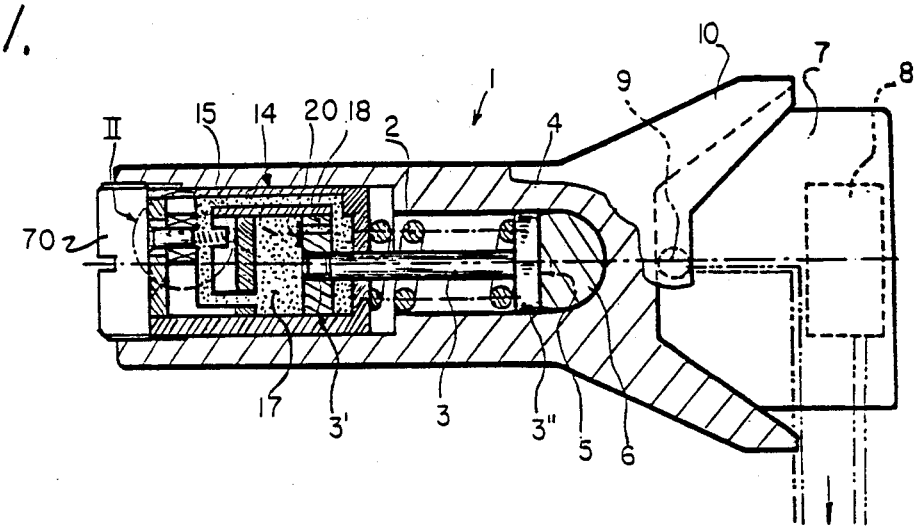
FIG. 1 is a partial cut-away cross-sectional top view of a ski binding with a hydraulic release assistance system with an electronic release mechanism.
Figure 2:
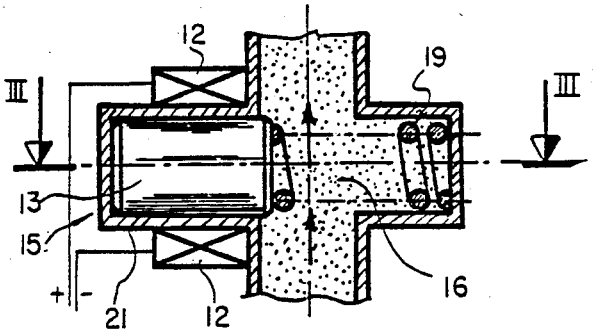
FIG. 2 is an enlarged top view of the dotted circle II in FIG. 1 and shows the hydraulic piston control apparatus positioned in the ski binding.

FIG. 1, which illustrates the first embodiment of the present invention, shows a front portion of a casing of a ski binding that is adapted to engage the toe of a ski boot. The casing includes a foot rest plate 7, upon which the sole of the boot rests, and a sole gripping element 10 for gripping the sole of the ski boot.

The binding is releasably held to the boot by a mechanical release mechanism which functions in conjunction with an electronic release assistance system, which assists the mechanical release mechanism in a manner which will be described hereinbelow.

The binding comprises a casing 1 including a pivotable element 4. Disposed inside pivotable element 4 is the mechanical release system. This system includes a primary release piston 3 and primary release spring 2. Release piston 3 is spring biased by a primary release spring 2 to contact flattened portion 5 of an element or shaft 6 which is fixed to the ski, as is known in the art. When the ski encounters various forces during skiing, pivotable element 4 and primary release piston 3 pivot around flattened portion 5 of shaft 6. This pivoting movement is resisted by piston 3 because spring 2 produces an initial release retention force which causes the binding to resist pivoting around shaft 6. The force exerted by release spring 2 one end 3″ of piston 3 is adjustable by an adjustment screw 70.

The electronic release assistance system which increases the initial release retention force, comprises a hydraulic mechanism responsive to the forces applied to the boot via an electronic control system. The hydraulic mechanism is adapted to further bias piston 3 and increase the release retention force exerted on the binding. The electronic control system controls the force exerted by the hydraulic mechanism on the mechanical release mechanism, and comprises a pair of sensors 8 and 9, which are disposed, respectively, on foot rest plate 7 and sole gripping element 10. Sensor 8 detects vertical forces directed from the toe of the boot downward. Sensor 9 detects vertical forces directed from the sole of the boot upward.

Figure 3:
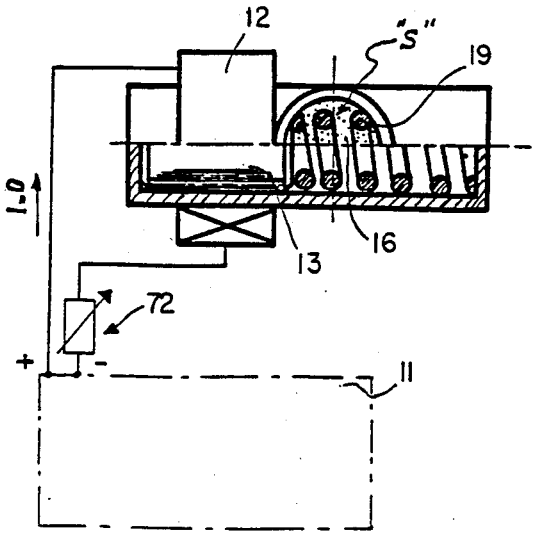
FIG. 3 is a partial cross-sectional cut-away view taken along line III—III of FIG. 2.

Sensors 8 and 9 are linked by electronic circuits to a current supply 11, shown schematically in FIG. 3. Current supply 11 retransmits signals received from sensors 8 and 9 to a solenoid coil 12. When solenoid coil 12 receives this current from supply 11, it causes a secondary piston 13 disposed in cylindrical cavity 21 to move in a direction parallel to the reciprocating movement of piston 3, as shown in FIG. 1.

Current supply 11 may be manually adjusted by adjustment element 72 so as to determine the amount of current transmitted to solenoid 12 for a given force or torque detected by sensors 8 and 9. Thus, by adjusting current supply 11 via adjustment element 72, the position and movement of secondary piston 13 may be controlled. The position of piston 13 determines the additional bias that may be placed on piston 3, thereby increasing the initial release retention force in a manner that will now be described.

Secondary piston 13 is part of a hydraulic mechanism 14, which comprises a hydraulic circuit 15 having two chambers 16 and 17 which are adapted to be filled with a hydraulic fluid and which are connected to each other. Primary chamber 17 receives one end 3' of primary release piston 3. The other end 3'' of piston 3 contacts flat portion 5 of shaft 6 under the influence of spring 2. End 3' is connected to a sliding element or bumper 18. Sliding element 18 is adapted to move in primary chamber 17 in response to, for example, a lateral shock received by pivotable element 4. Because primary chamber 17 has a greater cross-sectional area and a smaller total area than secondary chamber 16, there is a decrease in the fluid flow through the circuit when bumper 18 moves in chamber 17 due to a lateral shock. This decrease in fluid flow creates a brake force which acts on sliding element 18 in the direction opposite from the movement of element 18. Because element 18 is connected to piston 3, the brake force acts in the opposite direction from the movement of piston 3. Thus, piston 3 is biased against shaft 6 by both release spring and hydraulic circuit 15. In other words, the hydraulic circuit and the primary spring are coupled together. In the presence of shocks, even when the electronic system fails, the coupling of the hydraulic circuit and the primary spring may cause a temporary increase in the release retention force. This occurs because, if piston 3 moves rapidly in response to sudden shocks, a brake force is created resisting such movement, thereby increasing the release retention force of piston 3 on flat portion 5 of shaft 6. In fact, the more rapid the movement of piston 3 caused by sudden shocks, the larger the force exerted by the piston on shaft 3. Thus, in the event of sudden shocks, the release retention force may increase, even when the electronic control of the hydraulic current fails.

Figure 15:
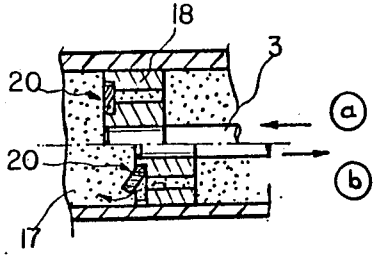
FIGS. 15*a* and 15*b* illustrate a portion of FIG. 1, which is enlarged and shows the bumper 18 and anti-return valve 20.
Figure 14:
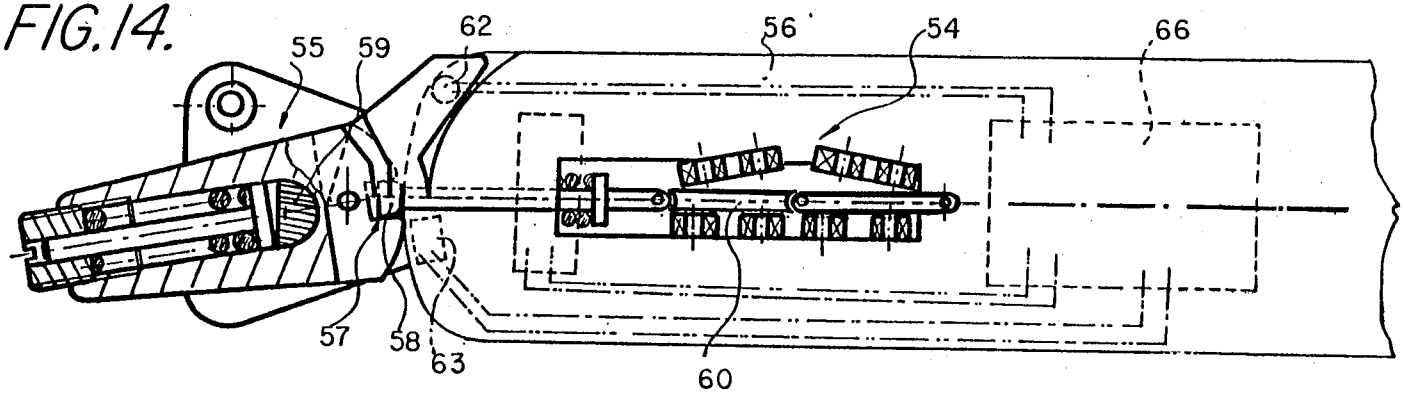

The velocity of the fluid flow and, consequently, the force applied by the fluid on piston 3 may be regulated or adjusted by an adjustable, anti-return valve on bumper 18, which is schematically shown for simplicity in FIG. 1. A more detailed view of anti-return valve 20 is found in FIG. 15, which will now be described. FIG. 15*a* illustrates the operation of the anti-return valve 20 during the release phase of the binding, starting from the time the binding begins to release the boot, and continuing until the boot is completely released. In this phase, valve 20 obstructs the opening in bumper 18, thereby pushing the fluid back in hydraulic circuit 15 and allowing the power output to be adjusted in the secondary chamber 16. FIG. 15*b* illustrates the position of the valve 20 when pivoting element 4 is brought back to its original, centered position. In this position, a minimum loss of fluid is desirable and the fluid passes directly through the openings in bumper 18 because valve 20 is moved away from its location obstructing the hole in bumper 18. Note that to facilitate a comparison of the drawings, FIGS. 15*a* and 15*b* are symmetrical.

It should be noted that the invention will work equally well by replacing hydraulic mechanism 15 with either a pneumatic mechanism or a mechanical mechanism.

When sensors 8 and 9 are under no pressure, indicating that a boot is not attached to the binding, no current is retransmitted by current supply 11 to coil 12. Consequently, secondary piston 13 is retracted to the maximum extent possible by release spring 19 into cylindrical cavity 21 so that the area of fluid passage S (as seen in FIG. 3) in secondary chamber 16 is at a maximum. Consequently, the force exerted by the fluid against one end 3' of piston 3 in the hydraulic mechanism 14 is at a minimum. Thus, the release retention force for retaining binding 1 in its central or retaining position, as seen in FIG. 1 is determined by release spring 2. The force retaining the binding in its central retaining position due to spring 2 alone, is called the initial release retaining force.

Before attaching the binding to the boot, the skier adjusts adjustment element 70 so as to determine the minimum initial release retention force that he desires to hold the binding to the boot. At this stage, before attaching the binding to the ski, the release assistance system produces no discernable effect. The minimal release retention force chosen by the skier is determined by adjustment element 70, which adjusts the bias of primary release spring 2.

Figure 4:
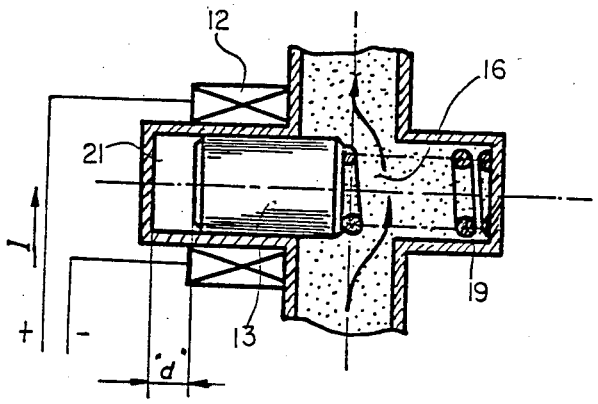
FIG. 4 illustrates an enlarged top view of the dotted circle II in FIG. 1 and shows the hydraulic position of the piston when it is biased by the solenoid.
Figure 5:
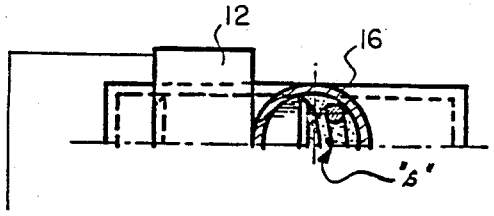
FIG. 5 illustrates a partial cross-sectional view taken along line III—III of FIG. 2 of the hydraulic piston when the solenoid is activated.

After adjusting release spring 2, the boot is attached to the binding. Sensors 8 and 9 experience pressure from the boot and send a signal to current supply 11, which in turn transmits a current of intensity I to solenoid coil 12. The current "I" passing through coil 12 causes secondary piston 13 to advance a distance "d" into secondary chamber 16, as seen in FIGS. 4 and 5. As a consequence of advancing into secondary chamber 16, piston 13 reduces the area of the fluid flow passage through secondary chamber 16, as seen by the curved arrows in FIG. 4. The amount of the reduction in the area of the fluid flow passage is indicated by "s", seen in FIG. 5. A reduction in the area of chamber 16 increases the initial release retention force on piston 3. This increase in the release retention force via a manipulation of piston 13 can be adjusted by adjustment knob 72 so that the skier can electronically adjust the increase in the initial release retention force to correspond to his desired reference release retention force. Thus, the skier chooses a minimum value for the release retention force by adjusting principal spring 2, and then adds to this minimum value an additional amount by adjusting adjustment element 72 in the release assistance system.

In the event that an incident occurs during skiing wherein the toe of the boot, the sole gripping element, or the foot rest plate experiences forces that cannot be controlled by the skier, the release assistance system reduces the release retention force as follows:

First, these forces occurring at the toe of the boot, the sole gripping element, or at the foot rest plate are detected by sensors 8 and/or 9. Next, the electronic circuit transmits a current $i_1 = \leqq$ to I to coil 12. Because current $i_1$ may be less than I, piston 13 experiences less of a force from coil 12 to counteract the force exerted on it by release spring 19. Consequently, release spring 19 retracts piston 13 into cylindrical cavity 21. The distance to which cylinder 13 is retracted back into cavity 21 is determined by current $i_1$, which in turn is determined by the strength of these forces measured by sensors 8 and/or 9. As a result of secondary piston 13 being retracted into cylindrical cavity 21, the fluid passage area in chamber 16 is increased with the consequent decrease in the release retention force experienced by piston 3, and the binding may therefore be more easily released from the boot.

In addition, if for any reason electronic circuit 11 fails, coil 12 will no longer receive current, and piston 13 will retract to the maximum extent possible into its cavity 21, thereby causing the fluid passage area to have its initial value "S". Consequently, the skier once again finds the release retention force to be equal to the skiable minimum which he had adjusted for himself on the principal spring 2.

It should be noted that the release retention force is equal to the vectorial sum of the force exerted by primary release spring 2 and the force exerted by the hydraulic mechanism 14 or any comparable mechanical or pneumatic mechanism or system. In the case of an electronic circuit failure, primary release spring 2 alone cntinues to ensure the operation of the release mechanism.

Figure 6:
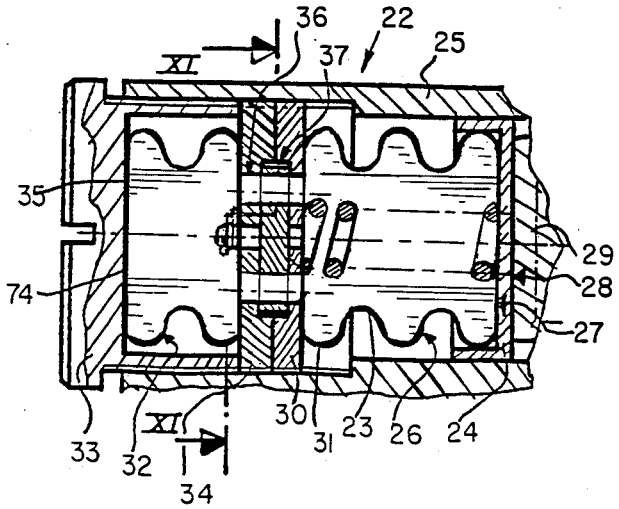
FIG. 6 is a schematic cross-sectional view of another embodiment of the hydraulic assistance system, which includes a diaphragm.
Figure 7:
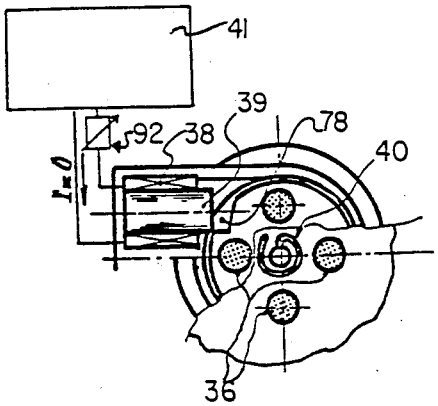
FIGS. 7 and 8 are partial cross-sectional views taken alone line XI—XI of FIG. 6, respectively, of different positions of the closing ring, which correspond to different levels of electromagnetic bias of the solenoid.
Figure 8:
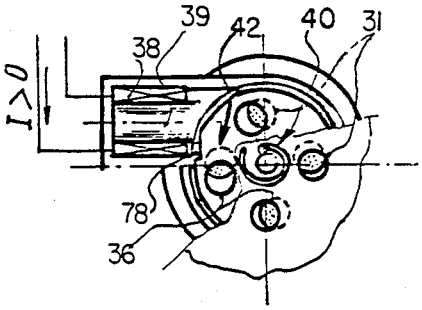

FIGS. 6 through 8 illustrate a second embodiment of the present invention which uses a release assistance system having a different hydraulic mechanism than the previous embodiment. As in the previous embodiment, a mechanical release system is provided for producing an initial release retention force on the binding for causing the binding to resist pivoting about an element fixed to the ski. Also, as in the previous embodiment, the release assistance system increases the initial release retention force.

FIG. 6 shows a section of a binding 25 that is pivotable about shaft 29 fixed to the ski. The binding includes, as in the first embodiment, a mechanical release mechanism comprising a primary piston 24, which is biased by a primary release spring 23 against the flat part 28 of shaft 29 to produce an initial release retention force to cause the binding and piston 4 to resist pivoting around shaft 29. The binding 25 also includes a release assistance system for increasing the initial release retention force. The release assistance system comprises a hydraulic circuit and a control system for controlling the force the hydraulic circuit exerts on the mechanical release mechanism. The hydraulic circuit includes a bellows diaphragm 22, which is coupled to primary release spring 23.

Bellows diaphragm 22 comprises a first bellows, called a primary bellows 26, inside of which is located the main spring 23. One end or edge 27 of primary bellows 26 rests on the inside of that portion of piston 24 which cooperates with flat part 28 of shaft 29. The other end 35 of primary bellows 26 is attached in a waterproof manner to a movable support 30 so that fluid inside primry bellows 26 does not leak out. Movable support 30 is adapted to move along the longitudinal axis of the binding. Because spring 23 is disposed between support 30 and piston 24 and is in contact with both of these elements, the tension of principal release spring 23 can be adjusted by moving support 30 along the longitudinal axis of the binding, thereby adjusting the initial release retention force on piston 24. Support 30 is moved along the longitudinal axis of the binding by threaded adjustment screw 33 in a manner that will be described hereinbelow.

Support 30 has openings 31 therein for allowing the passage of fluid between primary bellows 26 and secondary bellows 32, which is located on the other side of support 30. Secondary bellows 32 is located inside the threaded adjustment screw 33. One end of screw 33 rests on a closing ring 34, and one end 35 of secondary bellows 32 is attached in a waterproof manner, to closing ring 34. The other end is attached to screw 33 in a waterproof manner.

Closing ring 34 has the same number of openings 36 as support 30. Circular platform 37 also includes the same number of openings having the same location and size as those of support 30. In addition, the openings 36 are of the same size as openings 31 in support 30, although it is possible for the size of these openings to be different. Ring 34 and circular platform 37 preferably comprise one body.

Depending upon the position of closing ring 34, openings 36 in closing ring 34, and openings 31 in support 30 may be perfectly aligned (overlap completely) or may be partially overlapping, or may not overlap at all. Closing ring 34 and support 30 are held together in close proximity by pin 74, which passes through the centers of both closing ring 34 and support 30. Attached to pin 74 is a release spring 40, whose function will be described hereinbelow.

The electronic control mechanism comprises an electronic control and supply 41 connected to a solenoid coil 38. Coil 38 surrounds a finger 39 located and capable of moving radially with respect to closing ring 34, Control 41, as in the first embodiment, is electronically connected to sensors (not shown), which may transmit a signal to the control 41, which then retransmits the signal to coils 38. Control 41 also includes a manual adjustment 92 for determining the amount of current transmitted to solenoid coils 38 for a given signal from the sensors.

A sping 40 is provided which rests on stationary closing ring 34 and is connected to the axle of circular platform 37, so as to bias the circular platform 37 in the clockwise direction. Circular platform 37 therefore moves clockwise until it comes into contact with finger 39, which obstructs further clockwise movement of circular platform 37. This position of circular platform 37 is illustrated in FIG. 7. In this position, no current flows through coils 38. In a first position shown in FIG. 7, with no current flowing through coil 38, openings 31 in support 30 are perfectly aligned with openings 36 in closing ring 34 (e.g., completely overlap so that the longitudinal axes passing through the center of openings 31 and 36 substantially coincide) so that fluid may freely flow therethrough between primary bellows 26 and secondary bellows 32.

When sensors detect pressure thereon, for example, when the boots are attached to the binding, a signal is sent to electronic control 41 which retransmits a signal of appropriate strength to coil 38. Finger 39, which is adapted to move radially in recess 78, then acts as a magnet and attracts circular platform 37, which effects a rotation counterclockwise in the direction of arrow 42 against the bias of release spring 40. In this second position of circular platform 37, only a portion of openings 36 overlap openings 31. Consequently, the area available for fluid to flow through the passageway formed by the overlap of openings 36 and 31 is decreased, thereby increasing the back pressure on piston 24, which thereby increases the release retention force of piston 24 against shaft 29.

Before the skier attaches the boot to the binding, he may adjust the tension in spring 23 to a minimum initial reference value via adjustment screw 33. Because both closing circular platform 37 and support 30 may move along the longitudinal axis of the binding, screw 34, can determine the position of these elements and consequently the bias in spring 23. At this stage, no boot is detected in the binding by the sensors; therefore, coil 38 has no current passing therethrough, and finger 39 is in the position shown in FIG. 7 so that openings 31 and 36 are completely aligned and fluid flows freely therethrough. Thus, the electronic release assistance system, comprising the hydraulic mechanism and the electronic contol does not contribute to this minimum initial release retention force.

When the boot is attached to the binding, sensors detect pressure and electronic supply 41 activates coils 38 so as to retract finger 39, thereby decreasing the area through which the fluid may pass between principal bellows 26 and secondary bellows 32. The degree of obstruction may be controlled by varying adjustment element 92 on electronic control 41. Thus, the minimum initial release retention force determined by adjustment screw 33 has been increased by an amount which is determined by the skier by adjusting control 41.

As in the first embodiment, when shocks occur which generate forces over which the skier has no control, there forces are experienced by the sensors on the ski, and the current to coil 38 is reduced, thereby moving finger 39 further into recess 78 to pivot ring 34 so as to increase the area of fluid flow through openings 31 and 36, to decrease the release retention force. In addition, in case of electronic failure, the bining is still held on the ski by the mechanical system comprising spring 23 and piston 24, which was set by the skier before skiing.

Figure 9:
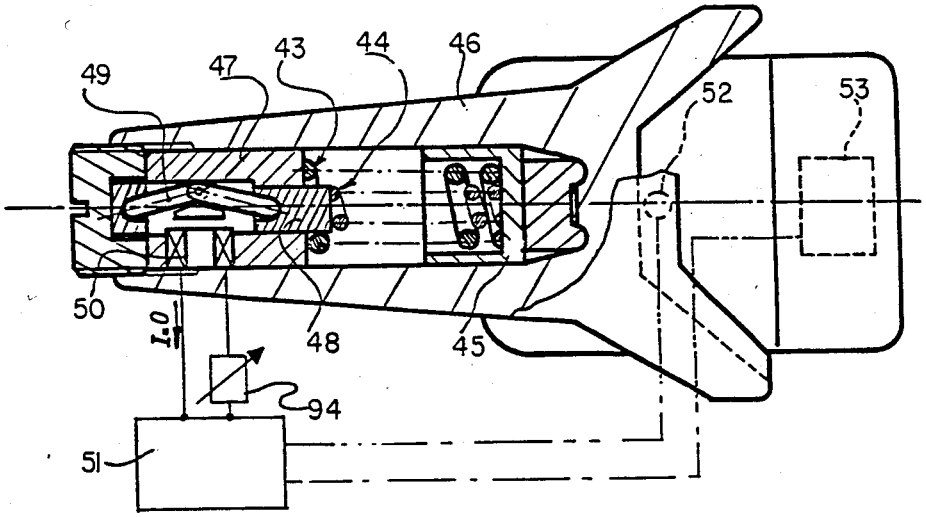
FIG. 9 illustrates a partial cross-sectional top view of another embodiment of a binding having an electromechanical release assistance system.
Figure 10:
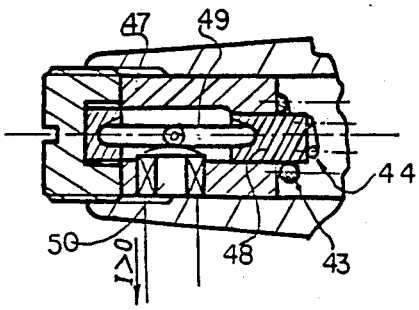
FIG. 10 illustrates a partial cross-sectional top view of a portion of FIG. 9, showing the position of the electro-mechanical assistance system for a given level of electromagnetic bias.

A third embodiment is illustrated in FIGS. 9 and 10. In this embodiment, there is a first mechanical release system for producing an initial release retention force on the binding to cause the binding to resists pivot about a shaft 82 attached to the ski, and an electro-mechanical assistance system for selectively increasing the initial release retention force. This assistance system comprises an electronic control and a second mechanical release. The second mechanical release includes an elastic element such as a spring 44 responsive to the electronic control system. The electronic system controls the amount of force added by the spring to the initial release retention force as will be explained hereinbelow.

FIG. 9 shows a binding having a pivotable casing 46 which may pivot about a shaft 82. Inside of casing 46 is a primary piston 45, which is biased against shaft 82 by primary spring 43. Primary spring 43 and piston 45 comprise the first mechanical release system.

Primary spring 43 is disposed between primary piston 45 and a sleeve 47 so that one end of spring 43 contacts primary piston 45 and the other end contacts a sleeve 47. Sleeve 47 is slidingly attached to casing 46 so that spring 43 therefore also contacts casing 46 via sleeve 47. Sleeve 47 in turn engages an adjustment stopping element 86. Adjustment element 86 may be moved along the longitudinal axis of the binding to move sleeve 47 and thereby bias primary spring 43 a given amount to be decided by the skier. Thus, the initial release retention force produced by spring 43 may be determined by the skier.

The electro-mechanical assistance system which assists the first mechanical system in resisting the pivoting of the binding comprises a secondary mechanical system and an electronic control system. The secondary mechanical system comprises a secondary spring 44, secondary piston 48, and toggle joint 49. These elements are responsive to an electronic control system comprising electromagnet 50, electronic circuit 51, and sensors 52 and 53.

Secondary spring 44 is disposed between secondary piston 48 and primary piston 45 so that one end contacts secondary piston 48, and the other end contacts primary piston 45. Secondary piston 48 is located in an opening in sleeve 47, and is adapted to reciprocate in sleeve 47. Its reciprocation is controlled by a toggle joint mechanism 49, as described hereinbelow. As piston 48 is extended or retracted, it will bias secondary spring 44, which in turn biases primary piston 45, thereby increasing the initial release retention force of the binding. It should be noted that the longitudinal axis of sleeve 47 and piston 48 are parallel to the longitudinal axes of both springs 43 and 48.

Sensors 52 and 53, which are placed, respectively on a sole gripping element 88 and a foot rest plate 90 of the casing, send a signal, when the boot is attached to the binding, to an electronic control circuit 51, which retransmits the signal to an electromagnet 50 located near toggle joint 49. The amount of current electromagnet 50 receives from circuit 51, determines how far toggle joint 49 is pivoted by the attraction to electromagnet 50, which in turn determines how far piston 48 will move out of sleeve 47. The position of piston 48, in turn, determines the bias spring 44 places on piston 45 and consequently the increase in the initial release retention force of the binding. The distance secondary piston 48 is moved out of sleeve 47, for example, shown in FIG. 10, for a given pressure sensed by sensors 52 or 53, may be adjusted manually by adjusting adjustment element 94 on electronic circuit 50.

Thus, the skier may adjust the initial release retention force using element 86 and the increase in the release retention force when the boots are attached to the binding using element 94.

In case of an electronic circuit failure, the toggle joint is automatically retracted to the position shown in FIG. 9, thereby retracting piston 48 into sleeve 47. As a consequence, the release retention force is determined by principal springs 43 alone, and the release retention force on piston 45 corresponds to the minimal skiable retention force set by the skier prior to placing the boot on the ski. It should be noted that in this embodiment, the release retention force added by the electro-mechanical assistance system to the initial release retention force is proportional to the value of the force produced by the principal adjustment spring 43.

As in the previous embodiments, when forces are experienced by sensors 52 and 53 over which the skier has no control, a signal is transmitted to the current supply 51 to reduce the current in electromagnet 50, thereby retracting piston 48 and reducing the release retention force on piston 45.

A fourth embodiment is illustrated in FIGS. 11 through 14. As seen in these figures, the first mechanical release system (a piston and spring) for producing the initial release retention force is in the binding 55, but the release assistance system 54 (comprising an element adapted to increase the initial release retention and the mechanism for increasing the release retention forces produced by the element) is placed in the sole 56 of the boot. The first mechanical release system again comprises a piston 96 biased by a spring 67 against a flattened portion of shaft 59 fixed to the ski. An adjustment element 99 adjusts the bias of spring 67, thereby controlling the initial release retention force. The assistance system located in the boot comprises an electronic control 66 which controls the movement of an element 58, which in turn determines the increase in initial release retention force as will be explained hereinbelow.

Figure 11:
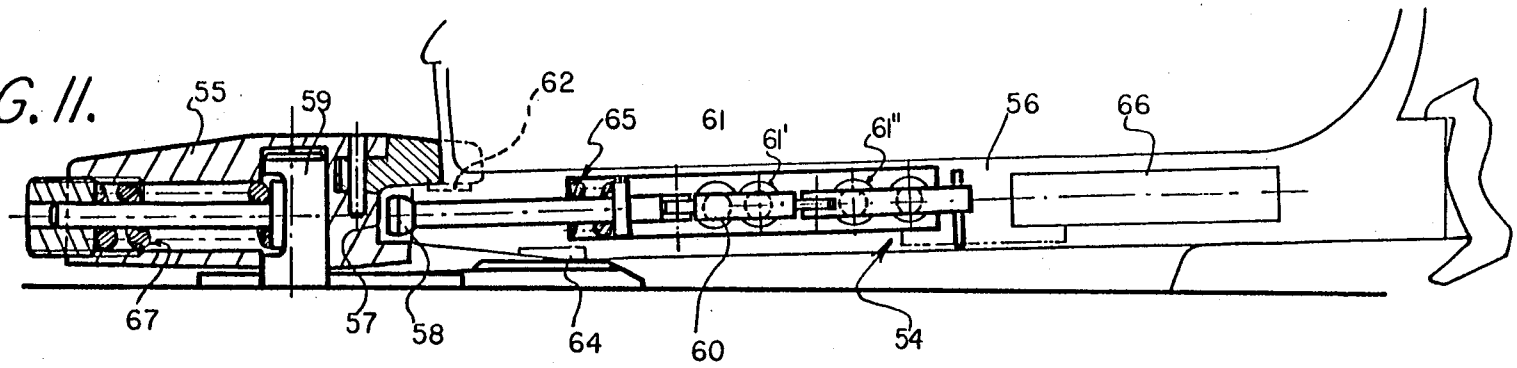
FIG. 11 illustrates a longitudinal cross-sectional side view of another embodiment of the present invention, wherein the electro-mechanical assistance system is located in the sole of the boot, and the principal release system is located in the binding casing.
Figure 12:
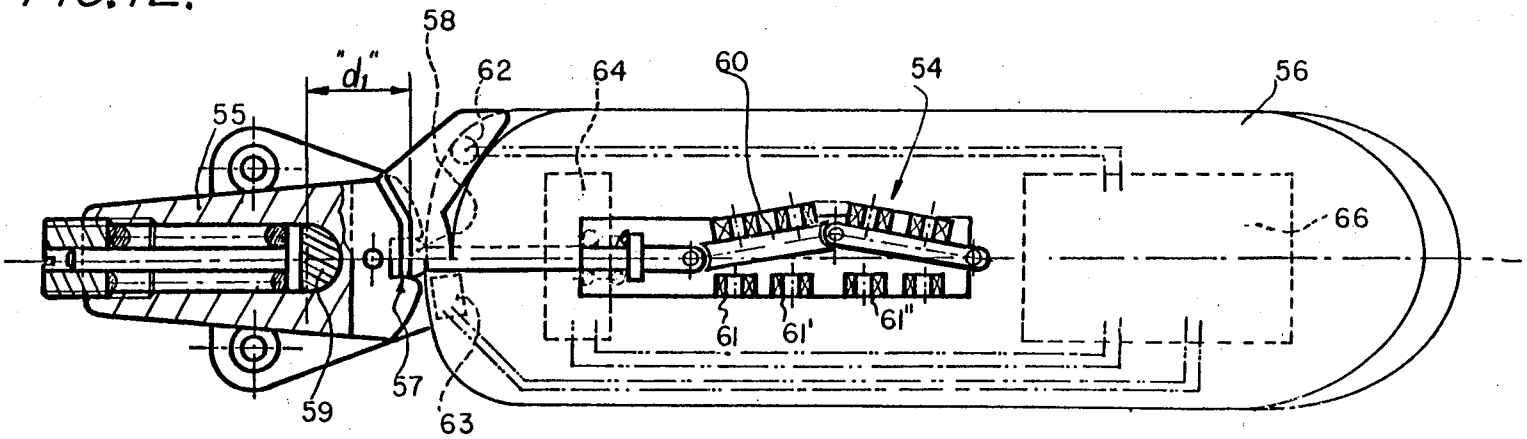
FIGS. 12, 13, and 14 illustrate partial cross-sectional top views of the apparatus of FIG. 11, wherein finger 58 experiences different levels of electromagnetic bias.

In this embodiment, casing 55 comprises a drive cavity 57 which is adapted to receive the element or control finger 58 from the boot. Control finger 58 is disposed along the same longitudinal axis as piston 96. The position of control finger 58 in cavity 57 determines the lever arm which represents the distance from finger 58 to pivot shaft 59, around which casing 55 pivots. By controlling this lever arm, the increase in the initial release retention force may be controlled. FIGS. 11 and 12 show finger 58 retracted to the maximum extent possible with respect to cavity 57. In this position the lever arm is $d_{11}$. In these drawings the toe of the boot is either loosely in contact with the binding or out of contact with the binding.

The movement of finger 58 in cavity 57 is controlled by a toggle joint 60 positioned in the sole of the boot. Electromagnets 61, 61', 61'', etc., are disposed near toggle joint 60 and control movement of toggle joint 60; these electromagnets, in turn, are controlled by signals or current which they receive from electronic control 66 in boot 56. Electronic control 66, in turn, transmits current to the electromagnets in response to signals received by sensors 62, 63, and 64 located in the sole gripping element and the foot rest plate of the casing. By changing the position of finger 58, the lever arm is changed, and the lateral release retention force is also changed and can, therefore, be controlled.

Figure 13:
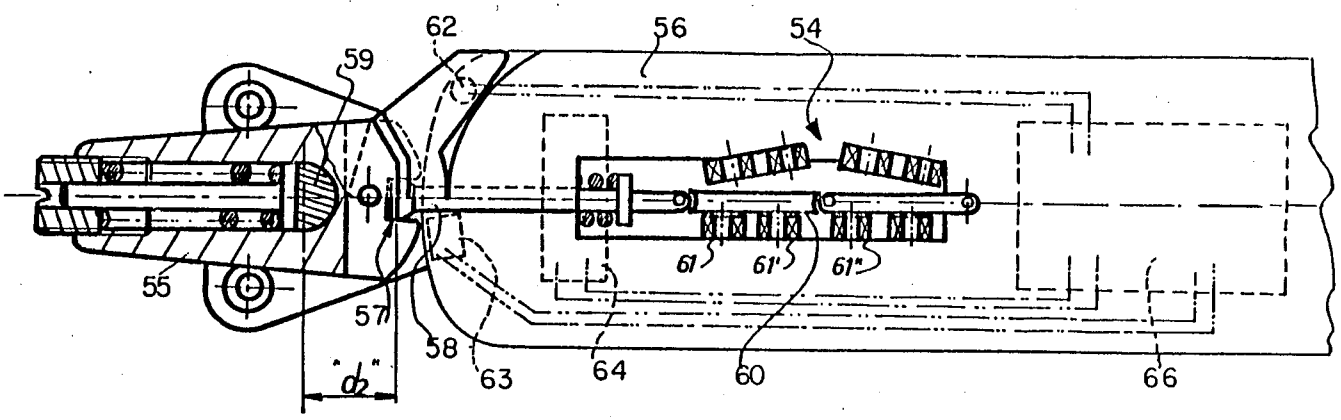

When the boot is not attached to the casing, sensors 62, 63, and 64 detect no pressure, and electromagnets 61, 61', and 61'' therefore receive no current. Consequently, control finger 58 is retracted out of cavity 57 due to the bias of release spring 65 and the lever arm is $d_1$. When the boot is attached to the casing, sensors detect the pressure from the boot and send a signal to an electronic calculator 66, which transmits a signal of a particular intensity to electromagnet 61, 61', and 61'' so as to move finger 58 a certain distance into cavity 57. The lever arm which was $d_1$ now becomes $d_2$, as seen in FIG. 13, as electromagnets are activated, and the toggle joint pushes control finger 58 in cavity 57. Conseqently, the release retention force increases by an amount that can be adjusted by an adjusting element 86 on electronic control 66. This release retention force thus corresponds to a given adjustment reference point chosen by the skier when the boots are attached to the binding.

When forces which the skier cannot control impinge upon the ski, they are detected by sensors 62, 63, and 64, which transmit a signal to electronic control 66. Electronic control 66 retransmits the signal of less intensity than the signal arising from the presence of the boot, to electromagnet coils 61, 61', and 61''. As a result, the finger retracts under the pressure of release spring 65. This increases the lever arm to between $d_2$ and $d_1$, and thereby decreases the release retention force.

In the case of electronic circuit failure, the command finger retracts completely under pressure from release spring 65 because electromagnet coils 61, 61', and 61'' receive no current. Thus, the release retention force, when there is electronic failure, corresponds to the minimum initial retention force necessary to ski, which was set by the skier before the boots were attached to the binding and which are determined by primary release spring 67 of the binding. It should be noted that although the above discussed embodiments are used on a binding that is attached to the toe of the boot, the invention will also perform well if used in conjunction with a binding that attaches to the heel of the boot.

The invention has been described with respect to the particular preferred embodiments. It is to be understood however, that the invention is not limited to the particular apparatus disclosed and that various modifications may be made in the apparatus without departing from the scope of the invention.

We claim:

1. A release mechanism for a binding that is pivotable about a fixed axis, said mechanism comprising:

(a) a first release means for producing an initial release retention force on said binding to cause said binding to resist pivoting about said fixed axis; and (b) a second release means for continuously increasing said initial release retention force, said second means comprising an electronic control mechanism for cntrolling the amount of increase in said initial release retention force.

2. The release mechanism of claim 1 wherein said second release means comprises means for reducing said increase in said initial release retention force due to said electronic control mechanism when said electronic control mechanism fails, wherein said first release mechanism continues to produce said initial release retention force, when said electronic control mechanism fails.

3. The release mechanism of claim 1 in combination with a binding which incorporates said first release means.

4. The release mechanism of claim 3, wherein said second release means further includes a force increasing means for increasing said initial release retention force, and said electronic control mechanism further includes (i) a current supply for supplying current to said force increasing means;

(ii) at least one sensor for sensing pressure on said binding, and sending a signal representing said pressure to said current supply, wherein the amount of force added by force means is determined by the pressure sensed by said sensors.

5. The release mechanism of claim 4, further including two sensors disposed respectively, on a sole gripping element and a foot rest plate of said binding.

6. The release mechanism of claim 4 wherein when a boot is attached to said binding, said sensors are placed under pressure and said force increasing means increases said initial release retention force.

7. The release mechanism of claim 4 wherein said first release means includes a piston and a spring in said binding, wherein said spring urges said piston against a fixed element attached to said ski to produce said initial release retention force.

8. A release mechanism for a binding that is pivotable about an element fixed to a ski, said mechanism comprising:

(a) a mechanical release means for producing an initial release retention force on said binding to cause said binding to resist pivoting about said element; and (b) an electronic release assistance system for increasing the initial release retention force, comprising:

(i) a hydraulic circuit adapted to exert a force on said mechanical release means, to increase said initial release retention force; and (ii) an electronic control means for controlling the amount of the force exerted by said hydraulic circuit on said mechanical release means.

9. A release mechanism for a binding that is pivotable about an element fixed to a ski, said mechanism comprising:

(a) a mechanical release means for producing an initial release retention force on said binding to cause said binding to resist pivoting about said element; and (b) an electronic release assistance system for increasing the initial release retention force, comprising:

(i) a hydraulic circuit adapted to exert force on said mechanical release means, to increase said initial release retention force; and (ii) an electronic control means for controlling the amount of the force exerted by said hydraulic circuit on said mechanical release means, wherein said mechanical release means includes:

(a) a primary piston having a first end in contact with said element and a second end in contact with said hydraulic circuit;

(b) a spring, biasing said first end against said element to produce said initial release rentention force.

10. The release mechanism of claim 9 further including an adjusting element for adjusting the bias of said spring.

11. The release mechanism of claim 9 wherein said hydraulic circuit comprises:

a primary chamber, wherein said second end of said piston is in contact therewith;

a secondary chamber of smaller cross-sectional area than said primary chamber and in communication therewith; and a secondary piston, adapted to reciprocate in said secondary chamber wherein said reciprocating movement is controlled by said electronic control means.

12. The release mechanism of claim 11, wherein said secondary chamber further includes a cavity adapted to receive said secondary piston, wherein when said secondary piston moves out of said cavity, said secondary piston reduces the area through which the fluid flows in said secondary chamber, thereby increasing the initial release retention force.

13. The release of claim 11 wherein said electronic control means comprises:

at least one sensor for sensing pressure on said binding and producing a signal; and a solenoid coil, adapted to receive current, disposed around said secondary piston wherein the current received by said solenoid is determined by said sensor.

14. The release of claim 13 wherein said electronic control further includes an adjustable current supply, wherein said sensor and said solenoid coil are electrically connected to said current supply, wherein the current sent to said solenoid coil for a given pressure sensed by said sensor is adjustable.

15. The release of claim 13 wherein said electronic control means includes two sensors disposed, respectively on a foot rest plate and a sole gripping element of said binding.

16. The release mechanism of claim 8 wherein said electronic release assistance system comprises means for reducing said increase in said initial release retention force due to said electronic control means when said electronic control means fails, wherein said mechanical release means continues to produce an initial release retention force on said binding when said electronic control means fails.

17. The release mechanism of claim 8 in combination with a binding which incorporates said release mechanism.

18. A release mechanism for a binding that is pivotable about an element fixed to a ski, comprising:

(a) a mechanical release means for producing an initial release retention force on said binding to cause said binding to resist pivoting about said element; and (b) a release assistance system for increasing the initial release retention force, comprising:

(i) a hydraulic circuit adapted to exert a force on said mechanical release means to increase said initial release retention force; and (ii) a control means for controlling the amount of force exerted by said hydraulic circuit on said mechanical release means.

19. The release mechanism of claim 18 wherein said mechanical release means includes a primary piston and a primary spring, wherein one end of said spring biases said piston against said element to produce said initial release retention force.

20. The release mechanism of claim 19 further including:

a support contacting the other end of said primary spring, wherein said support is adapted to be movable along the longitudinal axis of said binding, thereby controlling the force said spring exerts against said piston.

21. A release mechanism for a binding that is pivotable about an element fixed to a ski, comprising:

(a) a mechanical release means for producing an initial release retention force on said binding to cause said binding to resist pivoting about said element; and (b) a release assistance system for increasing the initial release retention force, comprising:

(i) a hydraulic circuit adapted to exert a force on said mechanical release means to increase said initial release retention force; and (ii) a control means for controlling the amount of force exerted by said hydraulic circuit on said mechanical release means, wherein said mechanical release means includes a primary piston and a primary spring, wherein one end of said spring biases said piston against said element to produce said initial release retention force, wherein said release mechanism further comprises:

a support contacting the other end of said primary spring, wherein said support is adapted to be movable along the longitudinal axis of said binding, thereby controlling the force said spring exerts against said piston, wherein said support has at least one opening therein and said hydraulic circuit comprises:

a diaphragm, adapted to contain said fluid and said primary spring, including:

a primary bellows disposed on one side of said support; and a secondary bellows disposed on the other side of said support and in fluid communication with said primary bellows through said opening in said support.

22. The release mechanism of claim 21 wherein said hydraulic circuit further includes:

a circular platform disposed between said secondary bellows and said support, and having at least one opening therein, and adapted to rotate, wherein said opening on said support and on said circular platform are located such that they completely overlap each other when said circular platform is in a first position, and they partially overlap one another when said circular platform is rotated to a second position.

23. The release mechanism of claim 22 wherein said circular platform further includes a recess on the edge thereof, and said control means further includes a finger, for controlling the rotation of said circular platform.

24. The release mechanism of claim 23, wherein said finger becomes magnetic in response to a signal from said control means, and further including a secondary spring, for biasing said circular platform toward said finger, wherein said circular platform is in said first position when said finger is not magnetic, and said circular platform moves to said second position when said finger becomes magnetic.

25. The release mechanism of claim 24 wherein said control means is an electronic control means and comprises a current supply and a solenoid coil receiving current therefrom, and for controlling magnetism of said finger.

26. The release mechanism of claim 25 further including at least one sensor for sensing pressure on said binding and sending a signal to said current supply, wherein in response to a signal from said sensor, said current supply sends a current to said solenoid coil to magnetize said finger.

27. The release mechanism of claim 18 in combination with a binding which incorporates said release mechanism.

28. A release mechanism for a binding that is pivotable about an element fixed to a ski, comprising:

(a) a first mechanical release means for producing an initial release retention force on said binding to cause said binding to resist pivoting about said element; and (b) an electro-mechanical assistance system for selectively continuously increasing the initial release retention force, comprising:

(i) an electronic control means; and (ii) a second mechanical release means comprising an elastic means, responsive to said electronic control means, for increasing said initial release retention force wherein said electronic control means controls the amount of increase in said initial release retention force.

29. The release mechanism of claim 28, wherein said first mechanical release means comprises;

a primary piston in contact with said element; and a primary spring biasing said piston against said element.

30. The release mechanism of claim 29 wherein said first mechanical release means further includes a sleeve, attached to said binding, wherein one end of said primary spring contacts said sleeve, and the other end of said primary spring contacts said piston.

31. The release mechanism of claim 30 wherein said sleeve is movable along the longitudinal axis of said binding and wherein said first mechanical release means further includes an adjustment element for controlling the position of said sleeve at locations along the longitudinal axis of said binding.

32. A release mechanism for a binding that is pivotable about an element fixed to a ski, comprising:

(a) a first mechanical release means for producing an initial release retention force on said binding to cause said binding to resist pivoting about said element; and (b) an electro-mechanical assistance system for selectively increasing the initial release retention force, comprising:

(i) an electronic control means; and (ii) a second mechanical release means comprising an elastic means, responsive to said electronic control means, for increasing said initial release retention force wherein said electronic control means controls the amount of increase in said initial release retention force, wherein said first mechanical release means comprises;

a primary piston in contact with said element; and a primary spring biasing said piston against said element, wherein said first mechanical release means further includes a sleeve, attached to said binding, wherein one end of said primary spring contacts said sleeve, and the other end of said primary spring contacts said piston, wherein said elastic means is a secondary spring and said sleeve has an opening therein and wherein said second mechanical release means further comprises a secondary piston adapted to reciprocate in said sleeve, and wherein said secondary spring contacts said primary and secondary pistons.

33. The release mechanism of claim 32 further including a toggle joint, for controlling the reciprocation of said secondary piston, and an electromagnet, responsive to said electronic control means and controlling the movement of said toggle.

34. The release mechanism of claim 33 further including at least one sensor on said binding for sensing pressure thereon and producing a signal and a current supply wherein said electromagnet is responsive current from said current supply and said current supply is responsive to said signal from said sensor.

35. The release mechanism of claim 34 further including two sensors respectively located on said foot rest plate and said sole gripping element of said binding.

36. The release mechanism of claim 28 in combination with a binding which incorporates said release mechanism.

37. A release for a binding having a cavity therein is pivotable about an element fixed to a ski, comprising:

(a) a first mechanical release means in said binding for producing an initial release retention force on said binding to cause said binding to resist pivoting about said element; and (b) an assistance system for selectively increasing said initial release retention force, comprising:

(i) an electronic control means; and (ii) an element attached to said boot and adapted to increase the initial release retention force, said element being responsive to said electronic control means, wherein said electronic control means controls the amount of increase in said initial release retention force.

38. The release mechanism of claim 37 wherein said element is a finger adapted to reciprocate with respect to said cavity in said binding, and said electronic control means controls the position of said finger with respect to said cavity.

39. A release for a binding having a cavity therein pivotable about an element fixed to a ski, comprising:

(a) a first mechanical release means in said binding for producing an initial release retention force on said binding to cause said binding to resist pivoting about said element; and (b) an assistance system for selectively increasing said initial release retention force, comprising:

(i) an electronic control means; and (ii) an element adapted to increase the initial release retention force, said element being responsive to said electronic control means wherein said electronic control means controls the amount of increase in said initial release retention force, wherein said element is a finger adapted to reciprocate with respect to said cavity in said binding, and said electronic control means controls the position of said finger with respect to said cavity, said mechanism further including a toggle joint, wherein the movement of said finger is controlled by said toggle joint, and said toggle joint is controlled by said electronic control means.

40. The release mechanism of claim 39 further including at least one electromagnet for controlling the movement of said toggle joint and which is controlled by said electronic control means.

41. The release mechanism of claim 40 wherein said electronic control means includes a current supply and at least one sensor for sensing pressure on said boot and sending a signal to said current supply, wherein said current from said current supply powers said electromagnet in response to a signal from said sensor.

42. The release mechanism of claim 41 further including two sensors, located respectively, on the foot rest plate and the sole gripping element of the binding.

43. The release mechanism of claim 37 wherein, when said assistance system fails, said first mechanical release means continues to provide an initial release retention force.

44. The release mechanism of claim 43, wherein said first mechanical release means includes a piston in contact with said element, and a spring biasing said piston against said element to produce said initial release retention force.

45. The release mechanism of claim 44 wherein said piston and said finger are disposed along the same longitudinal axis.

46. The release mechanism of claim 37 in combination with a boot incorporating said assistance system.

47. The release mechanism of claim 46 in combination with a binding incorporating said first mechanical release means.

48. The mechanism defined by claim 1 wherein said binding comprises a support non-pivotally fixed to said ski and a portion adapted to contact said support wherein said first release means comprises first means for elastically biasing said portion against said support and wherein said second release means comprises second means for elastically biasing said portion against said support.

49. A release mechanism for a binding that is pivotable about a fixed axis, said mechanism comprising:

(a) a first release means for producing an initial release retention force on said binding to cause said binding to resist pivoting about said fixed axis; and (b) a second release means for increasing said initial release retention force, said second means comprising an electronic control mechanism for actuating said increase in said initial release retention force, wherein said second release means comprises means for reducing said increase in said initial release retention force due to said electronic control mechanism when said electronic control mechanism fails.

50. The mechanism defined by claim 49 wherein said second release means comprises means for continuously increasing said initial release retention force and wherein said electronic control means controls the amount of increase in said initial release retention force.

51. The mechanism defined by claim 49 wherein said binding comprises a support non-pivotally fixed to said ski and a portion adapted to contact said support wherein said first release means comprises first means for elastically biasing said portion against said support and wherein said second release means comprises second means for elastically biasing said portion against said support.

52. The mechanism defined by claim 8 wherein said electronic release assistance system continuously increases said initial release retention force.

53. The mechanism defined by claim 8 wherein said electronic release assistance system comprises means for reducing said increase in said initial release retention force due to said electronic control means when said electronic control means fails.

54. The mechanism defined by claim 18 wherein said release assistance system comprises means for continuously increasing said initial release retention force.

55. The mechanism defined by claim 18 wherein said release assistance system comprises means for reducing said increase in said initial release retention force due to said control means when said control means fails.

56. The mechanism defined by claim 28 wherein said binding comprises a support non-pivotally fixed to said ski and a portion adapted to contact said support wherein said first release means comprises first means for elastically biasing said portion against said support and wherein said elastic means of said second mechanical release means comprises second means for elastically biasing said portion against said support.

57. The mechanism defined by claim 56 wherein said second mechanical release means comprises means for reducing said increase in said initial release retention force due to said electronic control means when said electronic control means fails.

58. The mechanism defined by claim 28 wherein said elastic means comprises means for reducing said increase in said initial release retention force due to said electronic control means when said electronic control means fails.

59. A release mechanism for a binding that is pivotable about an element fixed to a ski, comprising:

(a) a first mechanical release means for producing an initial release retention force on said binding to cause said binding to resist pivoting about said element; and (b) an electro-mechanical assistance system for selectively increasing the initial release retention force, comprising:

(i) an electronic control means for producing a signal; and (ii) a second mechanical release means comprising an elastic means, for increasing said initial release retention force only in response to said signal from said electronic control means.

60. The release defined by claim 37 wherein said electronic control means is adapted to produce a signal and wherein said element comprises means for increasing said initial release retention force only in response to said signal.

* * * * *